US008240525B2

(12) United States Patent
Stojkovski

(10) Patent No.: US 8,240,525 B2
(45) Date of Patent: Aug. 14, 2012

(54) DEVICE TO CARRY A BOTTLE

(75) Inventor: Peter Stojkovski, Earlwood (AU)

(73) Assignee: Innovative Ways Pty Ltd, Earlwood (AU)

( * ) Notice: Subject to any disclaimer, the term of this patent is extended or adjusted under 35 U.S.C. 154(b) by 665 days.

(21) Appl. No.: 12/303,850

(22) PCT Filed: Jun. 8, 2007

(86) PCT No.: PCT/AU2007/000811

§ 371 (c)(1), (2), (4) Date: Dec. 8, 2008

(87) PCT Pub. No.: WO2007/143775

PCT Pub. Date: Dec. 21, 2007

(65) Prior Publication Data

US 2010/0163587 A1 Jul. 1, 2010

(30) Foreign Application Priority Data

Jun. 16, 2006 (AU) ..... 2006903254

(51) Int. Cl.
*A45F 5/00* (2006.01)

(52) U.S. Cl. ..... 224/148.4

(58) Field of Classification Search ..... 224/148.4; 248/104

See application file for complete search history.

(56) References Cited

U.S. PATENT DOCUMENTS 1,692,098 A * 11/1928 Sullivan ..... 248/104
1,867,992 A * 7/1932 Sullivan ..... 248/104
2,258,076 A * 10/1941 Taylor et al. ..... 248/104
2,359,452 A * 10/1944 Summers, Sr ..... 248/104
2,470,379 A * 5/1949 Swaim ..... 248/104
2,557,570 A * 6/1951 Seiger ..... 248/104
2,590,383 A * 3/1952 Dean ..... 248/104
2,753,054 A * 7/1956 Becher ..... 211/73
2,938,693 A * 5/1960 Vardan ..... 248/104
3,003,727 A * 10/1961 Medor ..... 248/104
4,767,092 A * 8/1988 Weatherly ..... 248/311.2
5,016,845 A * 5/1991 Pellegrino ..... 248/104
5,409,151 A * 4/1995 Freimark ..... 224/148.6
5,489,075 A * 2/1996 Ible ..... 248/104
5,954,247 A * 9/1999 Savine et al. ..... 224/148.4
6,131,179 A 10/2000 Okita
6,394,329 B1 5/2002 Magee
6,581,886 B1 * 6/2003 Suh ..... 248/104
7,178,777 B1 * 2/2007 Banker ..... 248/316.7
7,404,534 B1 * 7/2008 Hajianpour ..... 248/230.1
7,744,053 B2 * 6/2010 Perman ..... 248/312
2002/0005418 A1 * 1/2002 Levesque et al. ..... 224/148.7
2004/0079843 A1 * 4/2004 Medwed et al. ..... 248/104
2004/0206789 A1 10/2004 Dahl
2004/0238578 A1 12/2004 Wagenknecht et al.
2005/0109803 A1 5/2005 Shin

FOREIGN PATENT DOCUMENTS

JP 2004315075 11/2004

* cited by examiner

*Primary Examiner* — Brian D Nash

(74) *Attorney, Agent, or Firm* — O'Shea Getz P.C.

(57) ABSTRACT

There is disclosed a device (1) to carry a bottle (5) including an attachment portion (10) to be secured to a user (15). A clip (20) has an aperture (25) through which a part (30) of the bottle (5) to be secured by the user may pass. A connecting means (35) extends between the attachment portion (10) and clip (20) and is operable to permit the bottle (15) in use to assume a substantially vertical orientation.

6 Claims, 10 Drawing Sheets

DEVICE TO CARRY A BOTTLE

This application is entitled to the benefit of, and incorporates by reference essential subject matter disclosed in PCT Application No. PCT/AU2007/000811 filed on Jun. 8, 2007 which claims priority to Australian Application No. 2006903254 filed Jun. 16, 2006.

FIELD OF THE INVENTION

The present invention relates to a device to carry a bottle, container or the like and, in particular, to a bottle holder to be fastened to a user.

BACKGROUND OF THE INVENTION

A vast array of bottles, containers and the like are sold throughout the world. It is typical for a user to carry a bottle in one hand. This creates a problem in that one hand of a user is utilized carrying the bottle and is unavailable for other use.

Accordingly, there is a need for a device to assist a user in carrying or holding a bottle so that the user's hands will remain free when not consuming the contents of the bottle. Backpacks, bum bags and other such devices have been developed to carry articles including bottles. However, backpacks and bum bags are bulky, expensive and limit movement of the user. There is a need for a device that can carry a bottle by simple attachment to a belt, waist or bag and can be substantially hidden from view when not in use.

One such device is shown in U.S. Pat. No. 6,131,779 to Gendala which describes a bottle carrier having a gripping section and a clip to attach to the belt or pants of a user. The disadvantage with such a device is that as the gripping section is of a fixed shape the carrier can only carry a very limited range of bottles. Further, as the gripping section is solid and inflexible, when a bottle is located within the gripping section and the user walks or runs, the bottle located within the gripping section easily dislodges itself from the carrier. Further, dislodging a bottle from the carrier creates a tugging sensation where the carrier attaches to the user making it uncomfortable for the user.

Accordingly, there is a need for an improved bottle holder/carrier that can accommodate a range of bottle sizes and shapes and will securely fasten a part of a bottle (such as the neck) during movement of a user.

OBJECT OF THE INVENTION

It is an object of the present invention to overcome or ameliorate some of the disadvantages of the prior art, or at least to provide a useful alternative.

SUMMARY OF THE INVENTION

There is firstly disclosed herein a device to carry a bottle including:

an attachment portion to be secured to a user;

a clip having an aperture through which a part of said bottle to be secured by said user may pass; and connecting means extending between the attachment portion and clip and operable to permit said bottle in use to assume a substantially vertical orientation.

There is further disclosed herein a bottle carrier to be attached to a bottle to secure the bottle to a user, said carrier including:

an attachment portion to be secured to the user; and a clip attached to the attachment portion and to engage the bottle so that the bottle is secured thereto, said clip having an aperture within which part of the bottle is located to be engaged by the clip, and wherein said clip is resiliently deformable to facilitate locations of said part in said aperture, with resilient deformation of said clip resulting in said clip being urged into clamping engagement with said part to thereby secure the bottle to the clip.

Preferably, said carrier includes means manipulated by a user to alter a size of said aperture.

Preferably, said alteration means is operable to move the clip between a first position when said aperture is expanded and a second position when said aperture is contracted.

Preferably, said alteration means includes a pair of opposing levers biased away from each other to urge said clip into the second position contracting said aperture.

Preferably, when said levers are urged towards each other said clip is moved to said first position expanding said aperture.

Preferably, said clip is formed of a single strand of wire.

Preferably, said strand is bent upon itself to include a figure eight.

Preferably, said attachment portion includes a pair of flanges divided by a slot, said flanges being generally parallel and connected by a joining portion.

Preferably, said attachment portion includes three substantially parallel flanges.

Preferably, said attachment portion and clip are pivotally connected together.

Preferably, said attachment portion and clip are hingedly connected together.

BRIEF DESCRIPTION OF THE DRAWINGS

A preferred embodiment of the invention will now be described, by way of example only, with reference to the accompanying drawings, wherein.

DETAILED DESCRIPTION OF THE PREFERRED EMBODIMENTS

Figure 3:
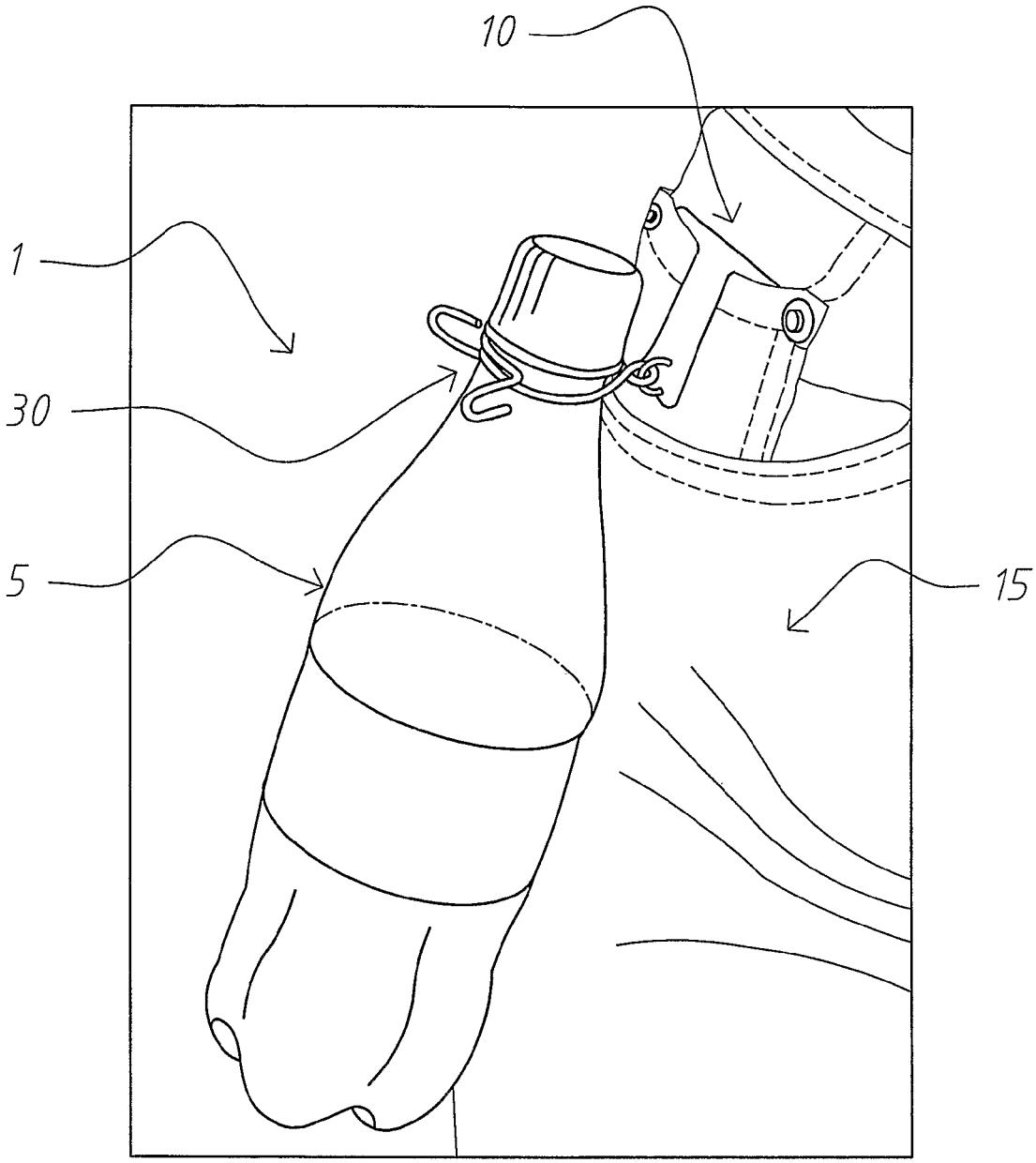
FIG. 3 is the device to carry a bottle of FIG. 1 shown in use attached to a user.

In the accompanying figures, there is disclosed a device 1 to carry a bottle 5 including an attachment portion 10 to be secured to a user 15 and a clip 20 having an aperture 25 through which a part 30 of the bottle 5 to be secured to a user 15 may pass. The part 30 is preferably the neck of the bottle 5, but could be any part of the bottle 5. Connecting means 35 extends between the attachment portion and clip 10, 20 and is operable to permit the bottle 5 in use to assume a substantially vertical orientation under the influence of gravity as best seen in FIG. 3. Therefore, there is disclosed a bottle carrier 1 to be attached to a bottle 5 to secure the bottle 5 to a user 15. The carrier 1 includes an attachment portion 10 to be secured to the user 15 and a clip 20 attached to the attachment portion 10 and to engage the bottle 5 so that the bottle 5 is secured thereto. The clip 20 has an aperture 25 within which part 30 of the bottle 5 is located to be engaged by the clip 20. The clip 20 is resiliently deformable to facilitate locations of the part 30 in the aperture 25, with resilient deformation of the clip 20 resulting in the clip 20 being urged into clamping engagement with the part 30 to thereby secure the bottle 5 to the clip 20.

Figure 1:
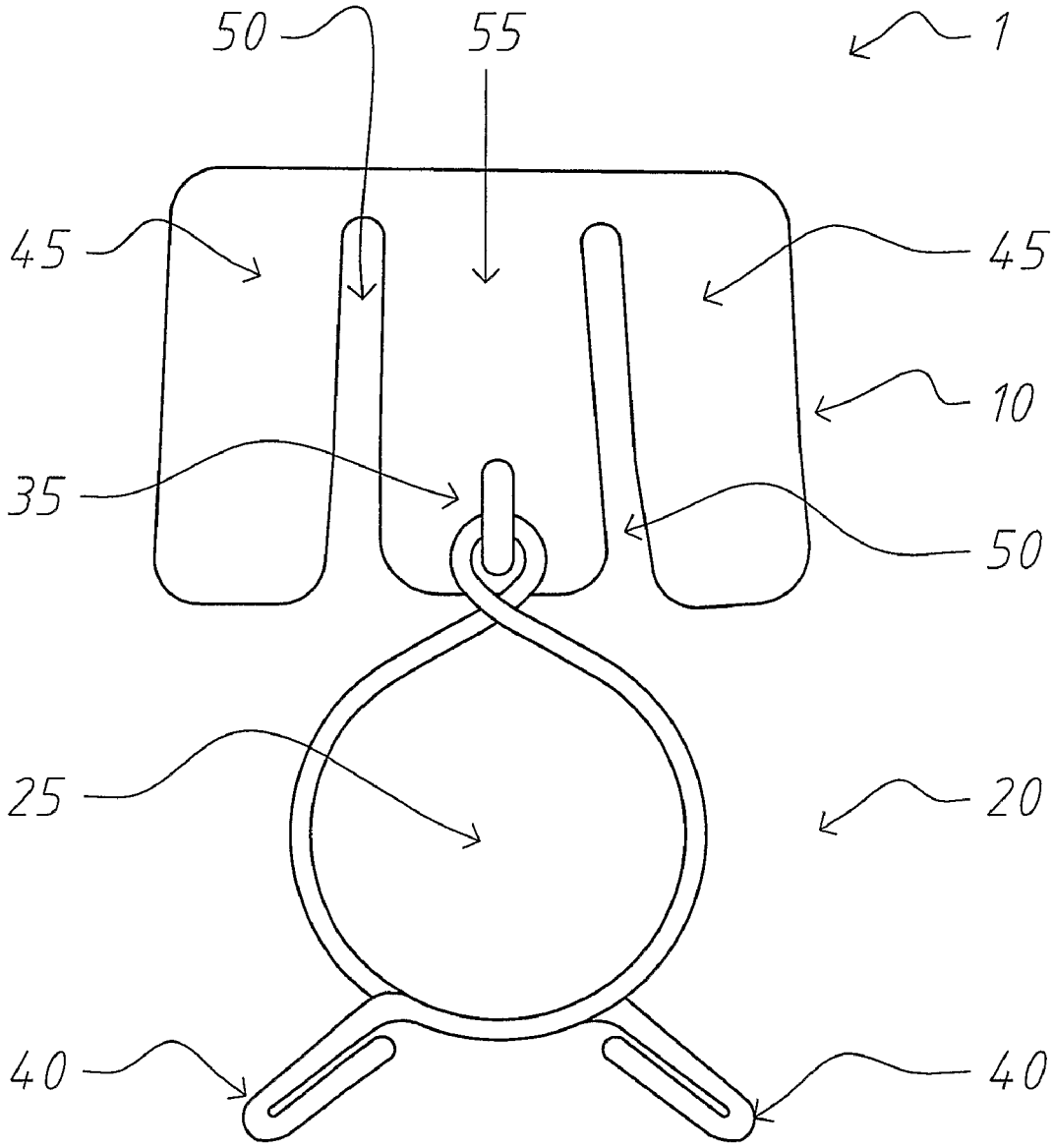
FIG. 1 is a first embodiment of a device to carry a bottle according to the present invention.
Figure 4:
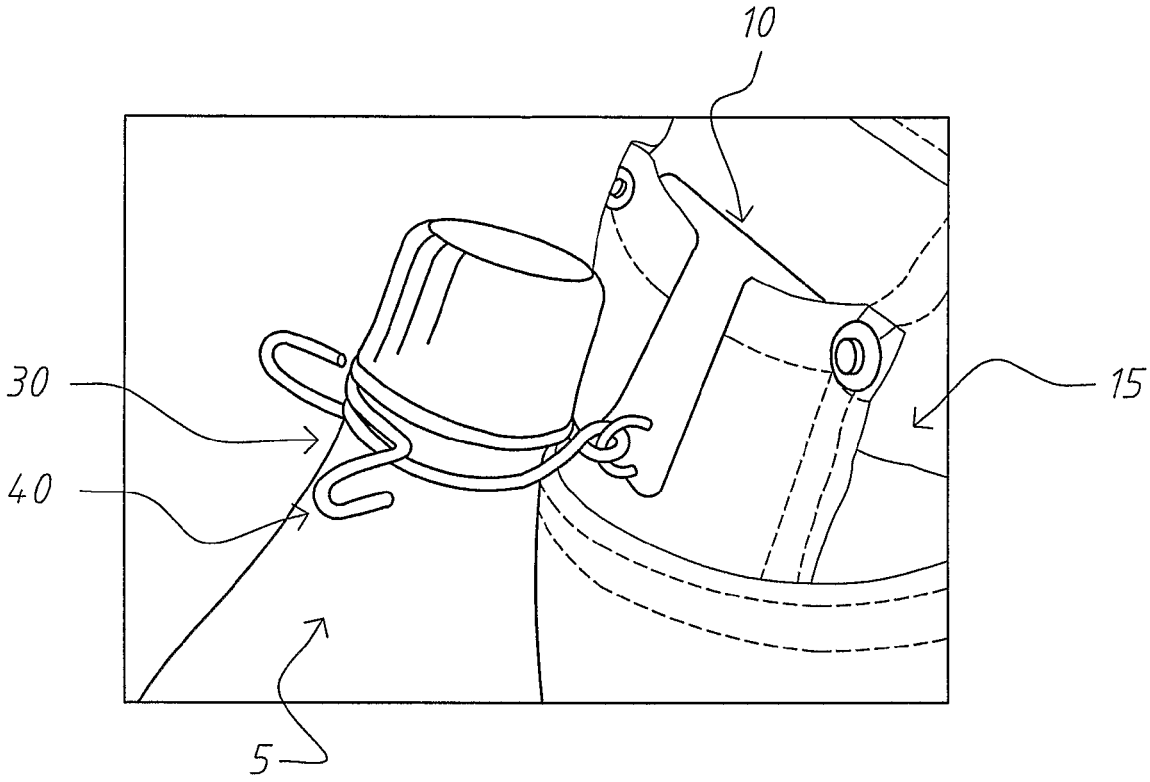
FIG. 4 is the device to carry a bottle of FIG. 1 shown in use attached to a user.
Figure 5:
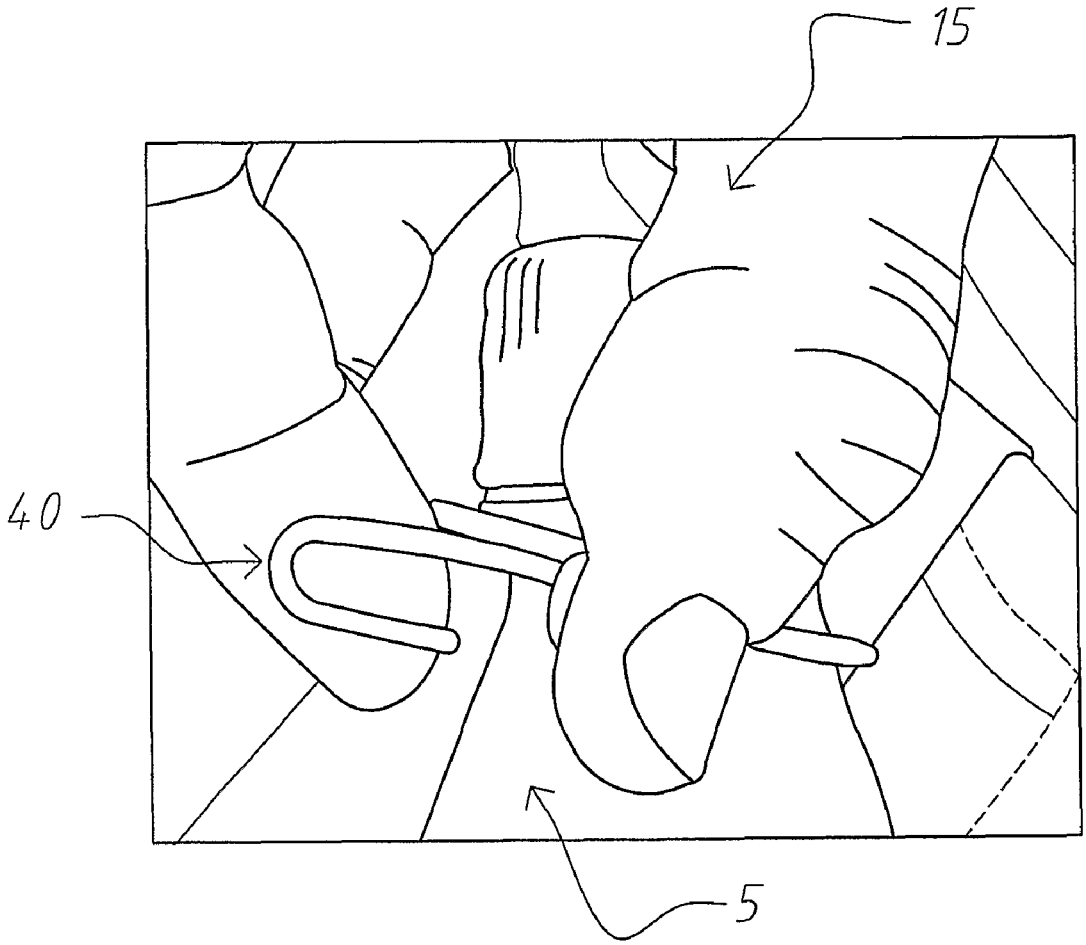
FIG. 5 is the device to carry a bottle of FIG. 1 shown manipulated by a user.
Figure 6:
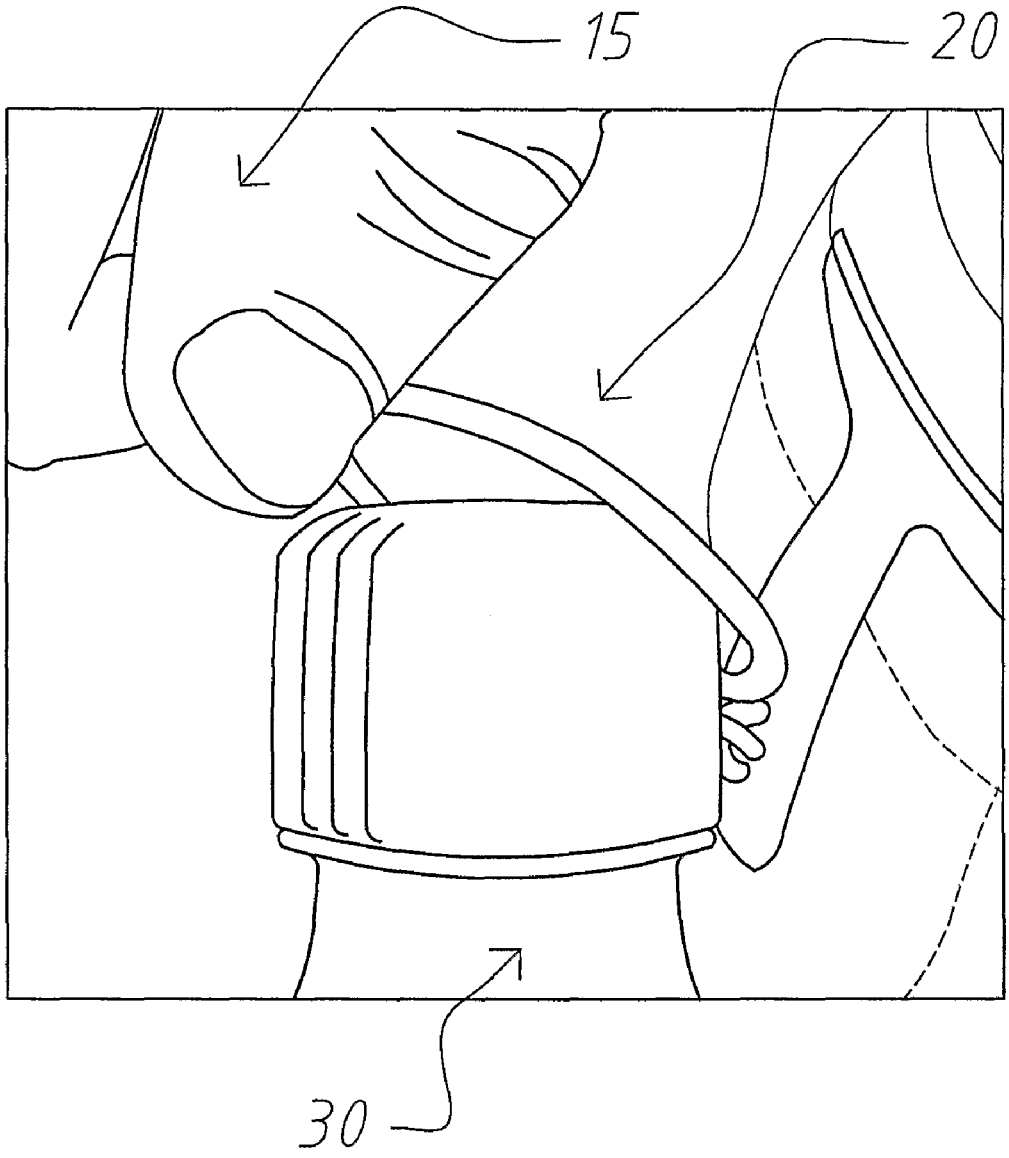
FIG. 6 is the device to carry a bottle of FIG. 1 shown manipulated by a user.
Figure 7:
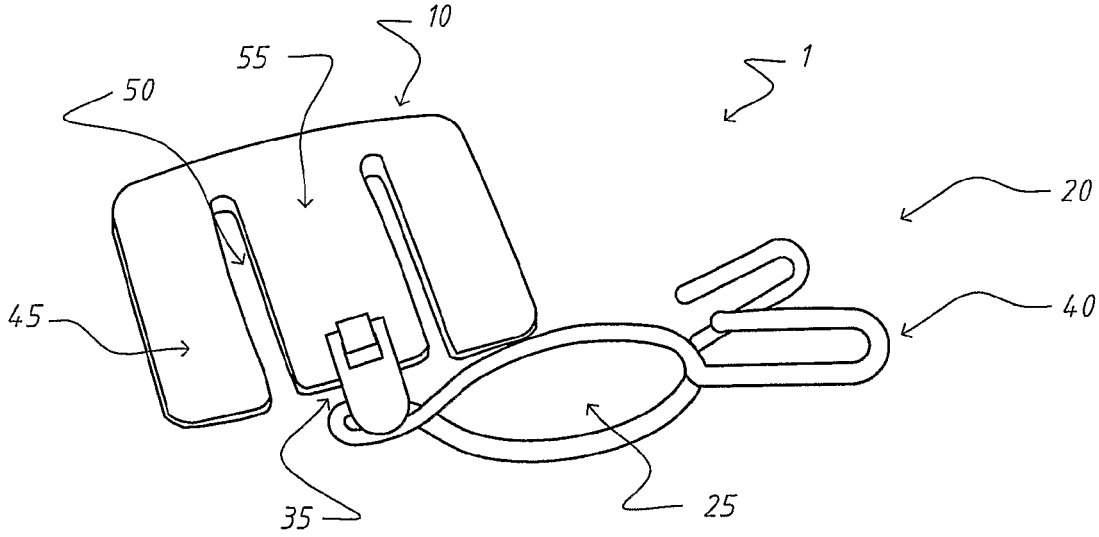
FIG. 7 is an alternate embodiment of the device to carry a bottle of the present invention.
Figure 8:
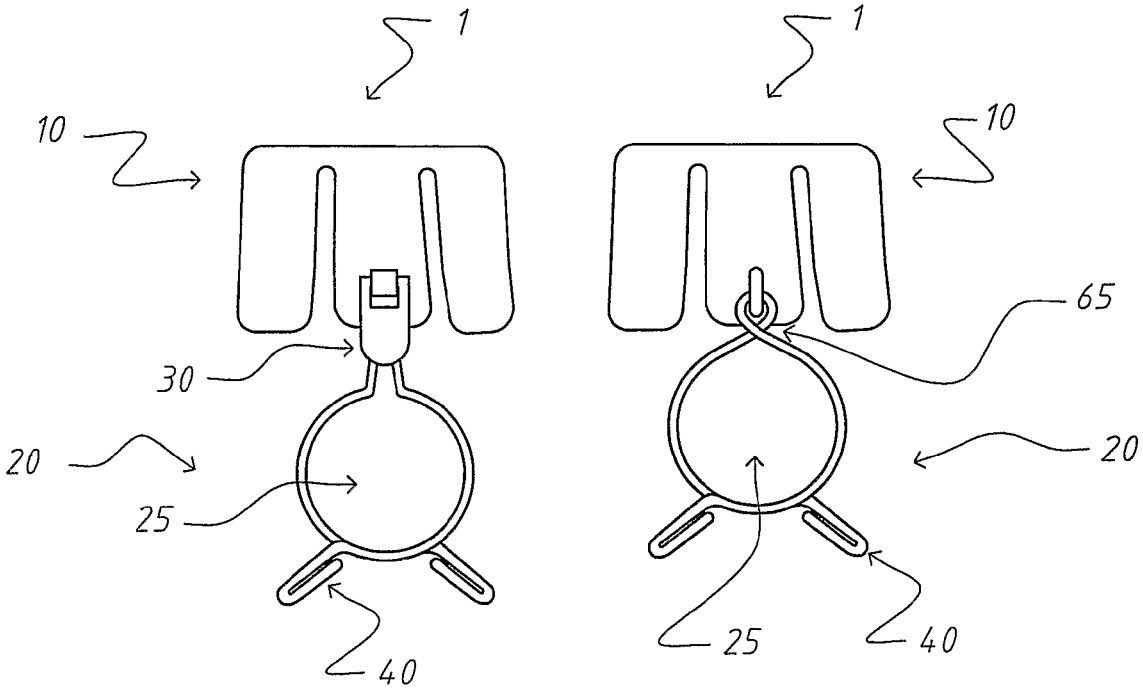
FIG. 8 is the device to carry a bottle of FIGS. 1 and 7 shown together.

The device 1 further includes means 40 manipulated by a user 15 to alter a size of the aperture 25 to accommodate bottles 5 of varying sizes. The alteration means 40 includes a pair of opposing levers biased away from each other. In use, the alteration means 40 is operable to move the clip 20 between a first position where the aperture 25 is expanded (see FIG. 6) and a second position where the aperture 25 is contracted (see FIG. 4). The bottle 5 is insertable through the aperture 25 in the first position and engages the clip 20 in the second position to thereby secure the bottle 5 to the user 15. The levers 40 are biased to urge the clip 20 into the second position contracting the aperture 25. The levers 40 are operable such that when urged by a user towards each other (as best seen in FIGS. 5 and 6) the clip 20 is moved to the first position expanding the aperture 25 which allows a bottle 5 to be removed or inserted into the device 1. In the preferred form, the clip 20 is formed of a single strand of wire bent or wound upon itself to include a figure eight or the like. Thus the clip 20 forms a spring like device. The attachment portion 10 includes a pair of flanges 45 divided by a slot 50. The flanges 45 are generally parallel and connected by a joining portion 55. In a preferred form (and as shown in FIG. 1) three flanges 45 and two slots 50 could be utilized. However, it should be understood that any number of flanges 45 and slots 50 could be used. The attachment portion and clip 10, 20 can be connected in any way. For example, they could be pivotably or hingedly connected. Two different connection means 35 are shown in FIG. 8. It should be understood that all parts of the device 1 can be manufactured of any material. In the preferred form, spring steel would be used for the clip 20 and plate steel would be used for the attachment portion 10 and connecting means 35.

Figure 2:
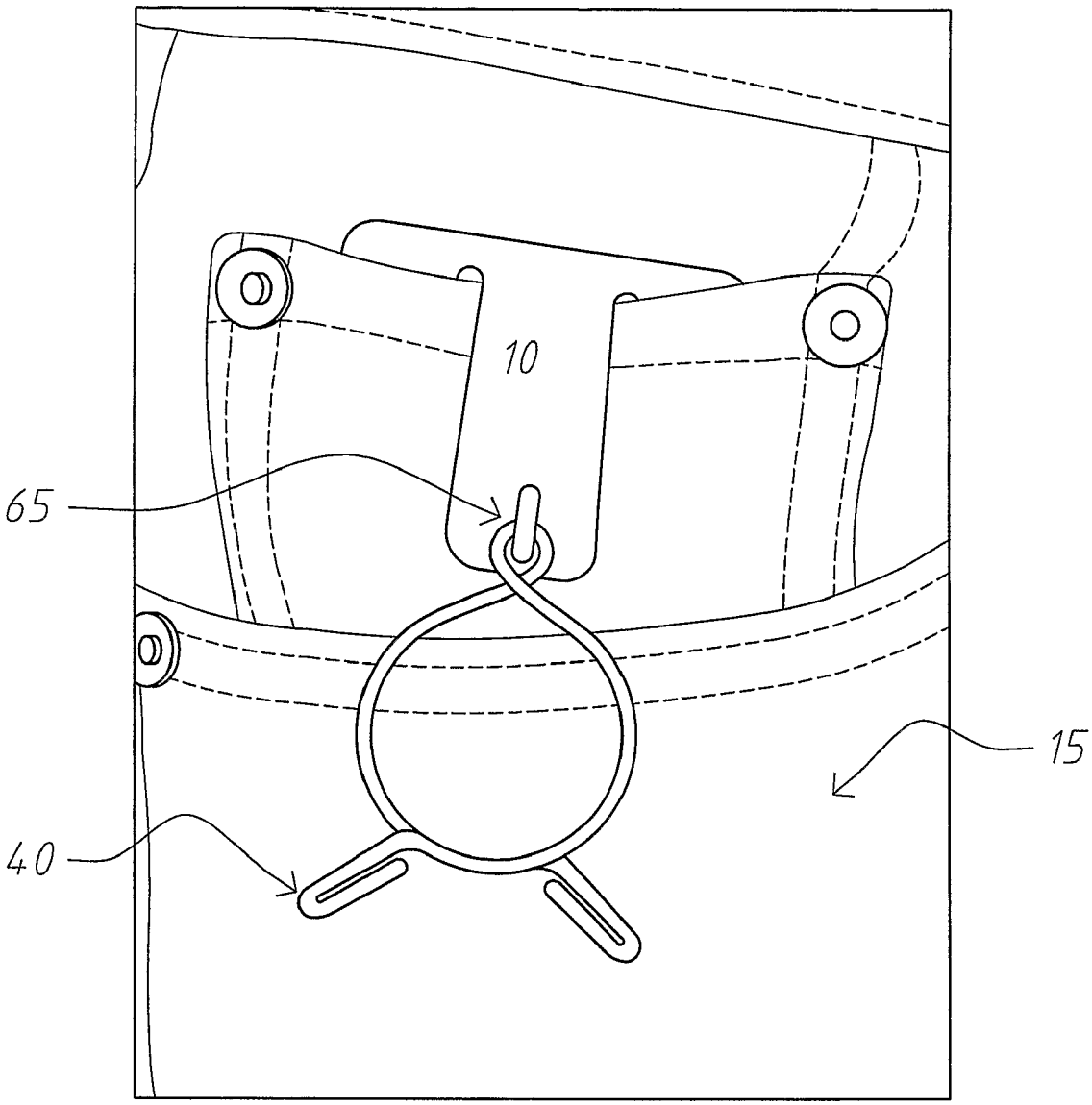
FIG. 2 is the device to carry a bottle of FIG. 1 shown in use attached to a user.

In use, a user 15 attaches the attachment portion 10 to themselves by inserting a part of their clothing, bag or the like between the slots 50 and flanges 45. As best seen in FIG. 2, this permits the clip 20 to extend downwardly away from the attachment portion 10 under its own weight. When a user 15 wishes to use the device 1 to retain a bottle 5 the user 15 would grip the clip 20 urging the levers 40 towards each other into the first position expanding the size of the aperture 25. Once the aperture 25 has been expanded, the cap 32 and neck 30 of a bottle can pass through the aperture 25 past the clip 20. Once the clip 20 surrounds the neck 30 of a bottle 5 the user 15 lets go of the clip 20 allowing the levers 40 to move away from each other back to the second position contracting the aperture 25 about the neck 30 of a bottle 5 and securing the bottle 5 to the user 15. To remove the bottle 5 from the device 1 the user 15 would simply repeat the above steps expanding the aperture 25 and releasing the bottle 5 from the clip 20 as seen in FIGS. 5 and 6.

Figure 9:
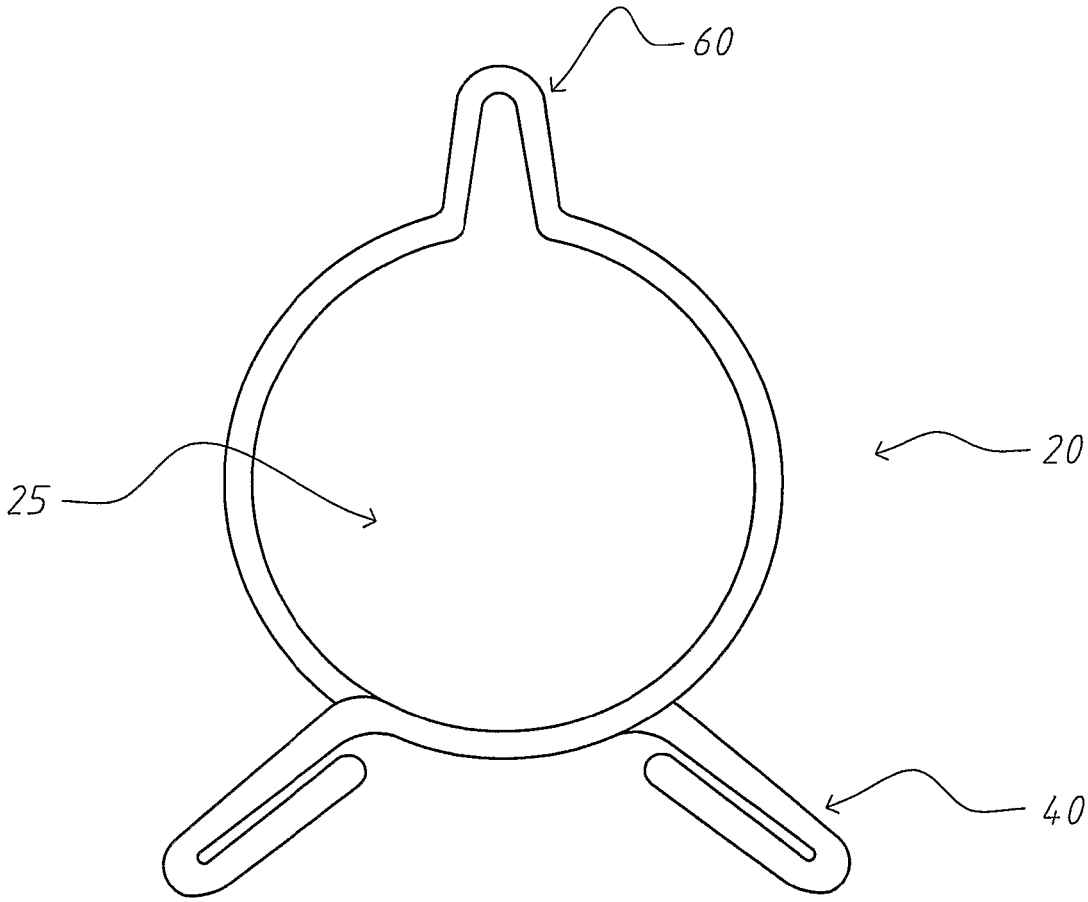
FIG. 9 is an alternative embodiment of the clip to carry a bottle of the present invention.
Figure 10:
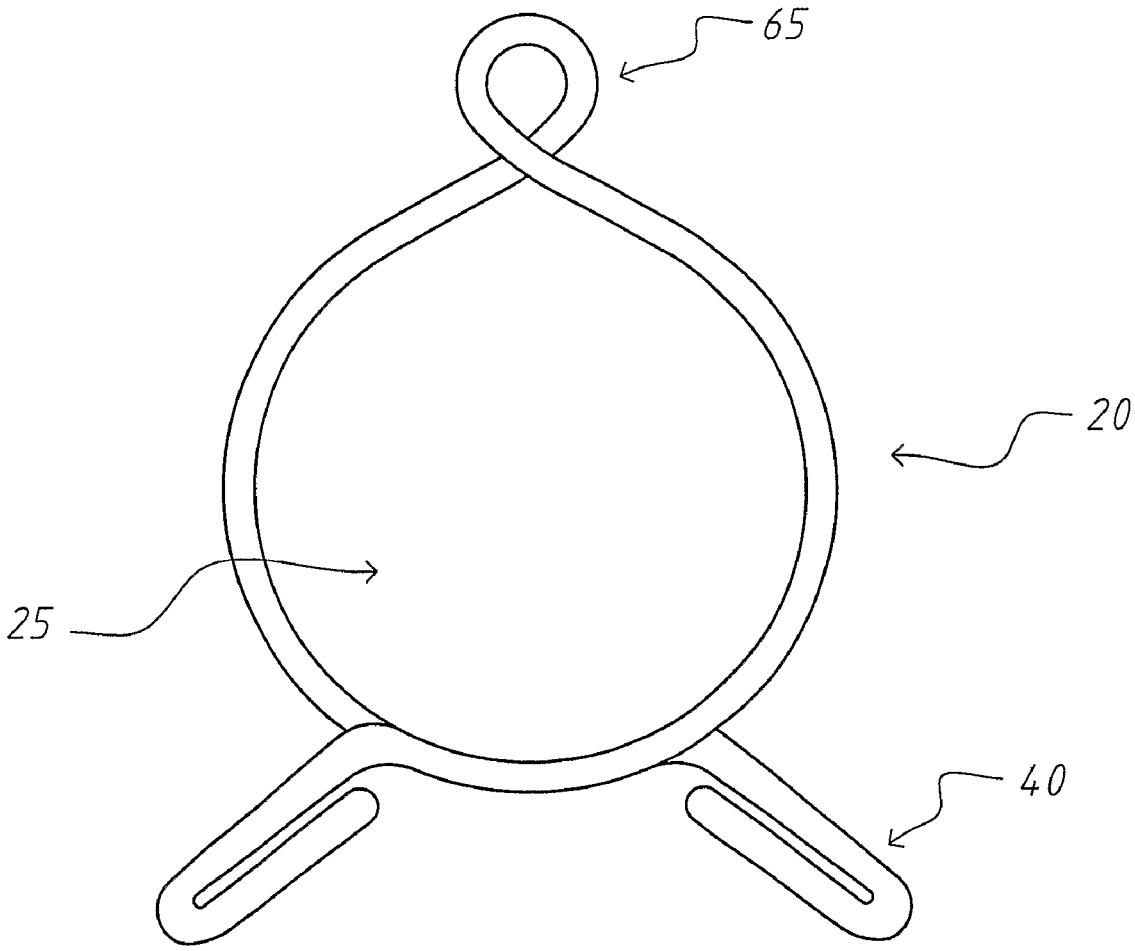
FIG. 10 is an alternative embodiment of the clip to carry a bottle of the present invention.

Due to the arrangement of the present invention in at least the preferred embodiments advantageously a bottle 5 will remain gripped by the device 1 under most movement of a user 15. The device 1 is very easy to use by all age groups, is safe to use without getting a user's fingers or the like caught or damaged and the clip 20 does not over-stretch and loose its resilience. Accordingly, by use of the device 1 a user's hands are free to be used for other functions whilst also carrying a bottle 5. Because the device 1 is small, after use it can easily be hidden away in a pocket or the like. Also, the three piece configuration permits swiveling of the clip 20 about the attachment portion 10. This makes it more comfortable for a user as the attachment portion 10 has minimal movement during use. Further, other embodiments including stylized devices having advertising logos or the like could be utilized on the attachment portion 10. The device 1 (as best shown in FIGS. 9 and 10) could include a "hump" 60 or figure eight 65 or the like.

Although the invention has been described with reference to specific examples, it will be appreciated by those skilled in the art that the invention may be embodied in many other forms.

What is claimed is:

1. A device to carry a bottle on a user, which bottle includes a neck, the device comprising:

an attachment portion operable to be secured to the user; and a clip operable to be attached to the attachment portion in a swivelable connection, which clip is selectively detachable at the connection, and which swivelable connection is operable to orient a bottle in a substantially vertical orientation, the clip having an aperture with a cross-sectional area in which the neck of the bottle is receiveable, and which clip is resiliently deformable to clamp the bottle neck, and to selectively change the cross-sectional area of the aperture to permit clamping bottle necks of different size;

wherein the clip is movable between a first position where the cross-sectional area of the aperture is expanded and a second position where the cross-sectional area of the aperture is contracted relative to the expanded first position;

wherein the clip is biased toward the second position; and wherein the clip includes a pair of opposing levers biased away from each other, and the clip is configured such that moving the levers toward one another moves the clip into the expanded first position.

2. The device of claim 1, wherein said clip is bent upon itself to include a figure eight.

3. The device of claim 1, wherein said attachment portion includes a pair of flanges divided by a slot, said flanges being generally parallel and connected by a joining portion.

4. The device of claim 3, including three substantially parallel flanges.

5. The device of claim 1, wherein the attachment portion is adapted to be secured adjacent the user's waist.

6. The device of claim 5, wherein the clip is adapted to be placed in the user's garment when not in use to substantially hide the device from view.

* * * * *